US007861707B2

(12) United States Patent
Wisener

(10) Patent No.: US 7,861,707 B2
(45) Date of Patent: Jan. 4, 2011

(54) GRAVITY FEED NATURAL DRAFT PELLET STOVE

(76) Inventor: Gary Wisener, 913 Orange St., Chowchilla, CA (US) 93610

( * ) Notice: Subject to any disclaimer, the term of this patent is extended or adjusted under 35 U.S.C. 154(b) by 1253 days.

(21) Appl. No.: 11/355,739

(22) Filed: Feb. 15, 2006

(65) Prior Publication Data

US 2007/0186920 A1 Aug. 16, 2007

(51) Int. Cl.

| | |
|---|---|
| ***F23B 50/10*** | (2006.01) |
| *F23B 10/00* | (2006.01) |
| *F23B 50/00* | (2006.01) |
| *F23B 50/12* | (2006.01) |

(52) U.S. Cl. ..... 126/68; 126/58; 126/73; 126/77; 110/101 R; 110/108; 110/267; 110/293; 236/11; 236/15 A; 236/38; 236/45

(58) Field of Classification Search ..... 126/26, 126/61, 67, 68, 72, 73, 77, 104 R, 107, 111, 126/245, 501, 502, 144, 152 A, 152 R, 290, 126/293, 307, 504; 110/101 R, 108, 118, 110/255, 257, 267, 292–295, 157, 158, 163, 110/273; 236/11, 15 A, 15 BD, 38, 39, 45
See application file for complete search history.

(56) References Cited

U.S. PATENT DOCUMENTS

| | | | | | |
|---|---|---|---|---|---|
| 39,535 | A | * | 8/1863 | Treadwell et al. | 126/68 |
| 44,091 | A | * | 9/1864 | Harrington | 126/293 |
| 44,959 | A | * | 11/1864 | Laman | 126/316 |
| 80,476 | A | * | 7/1868 | Hailes | 126/290 |
| 104,286 | A | * | 6/1870 | Eames | 126/80 |
| 130,692 | A | * | 8/1872 | Blanchard | 126/501 |
| 141,601 | A | * | 8/1873 | Skinner | 126/312 |
| 151,430 | A | * | 5/1874 | Proctor | 126/67 |
| 156,813 | A | * | 11/1874 | Palmie | 126/68 |
| 179,032 | A | * | 6/1876 | Lanphere | 126/67 |
| 183,075 | A | * | 10/1876 | Smead | 126/67 |
| 189,280 | A | * | 4/1877 | Stewart | 126/61 |
| 225,208 | A | * | 3/1880 | Blanchard | 126/73 |
| 308,911 | A | * | 12/1884 | Lowrey | 110/316 |
| 313,809 | A | * | 3/1885 | Combs | 126/312 |
| 469,380 | A | * | 2/1892 | Werzinger | 126/109 |
| 531,160 | A | * | 12/1894 | Claybourne | 406/92 |
| 544,038 | A | * | 8/1895 | Hoffman | 126/290 |
| 577,527 | A | * | 2/1897 | Hulbert | 126/290 |
| 649,154 | A | * | 5/1900 | Baughman | 126/225 |

(Continued)

*Primary Examiner*—Steven B McAllister
*Assistant Examiner*—Daniel E Namay
(74) *Attorney, Agent, or Firm*—Richard A. Ryan

(57) ABSTRACT

A pellet stove utilizing gravity feed and natural draft more effectively and efficiently burns pellet fuel while producing less air pollution and ash. In one embodiment, the pellet stove has a primary combustion area comprising a burn unit removably disposed in the vent tube, a feed tube defining a fuel chamber above the burn unit and a secondary combustion area, comprising a burn box defining a secondary burn chamber, below the burn unit. The burn unit has a removable receptacle which defines a primary burn chamber that receives pellet fuel from the fuel chamber and discharges substantially burned fuel to the secondary burn chamber for additional burning. Openings in the burn box, pellet receptacle and vent tube draw air into the burn chambers. A control mechanism controls the air flow to regulate the heat generated by the pellet stove. The pellet stove can be manufactured in various aesthetically pleasing designs.

20 Claims, 6 Drawing Sheets

U.S. PATENT DOCUMENTS 659,971 A * 10/1900 Hower ..... 126/68
665,947 A * 1/1901 West ..... 126/77
773,723 A * 11/1904 Farrington et al. ..... 126/312
786,555 A * 4/1905 Foster ..... 454/41
834,345 A * 10/1906 Utz ..... 126/58
1,032,015 A * 7/1912 McCall ..... 110/163
1,046,196 A * 12/1912 Kerruish ..... 110/309
1,151,308 A * 8/1915 Tucker ..... 110/157
1,168,951 A * 1/1916 Mandel ..... 110/157
1,496,015 A * 6/1924 Palmer ..... 110/317
1,561,497 A * 11/1925 Wier ..... 126/74
1,613,265 A * 1/1927 Bryer ..... 126/107
1,644,595 A * 10/1927 Karg ..... 126/67
1,648,976 A * 11/1927 Wagner ..... 126/68
1,708,310 A * 4/1929 Korngiebel ..... 236/45
1,808,487 A 6/1931 Ahlberg
1,980,692 A * 11/1934 Mason ..... 236/45
2,038,740 A * 4/1936 Kessler ..... 49/38
2,041,226 A * 5/1936 Chadwick ..... 126/67
2,153,106 A * 4/1939 Taylor ..... 126/225
2,272,468 A * 2/1942 Lange et al. ..... 236/45
2,443,346 A * 6/1948 Fair ..... 110/157
2,443,525 A * 6/1948 Weyenberg et al. ..... 110/175 R
2,483,702 A * 10/1949 Kacena et al. ..... 110/175 R
2,517,816 A * 8/1950 Weyenberg et al. ..... 110/193
2,540,657 A * 2/1951 Crumbaker ..... 110/175 R
4,182,304 A * 1/1980 Mele ..... 126/76
4,250,867 A * 2/1981 Andersen et al. ..... 126/502
4,320,738 A * 3/1982 Johnson ..... 126/77
4,380,228 A * 4/1983 Crowley ..... 126/76
4,404,953 A * 9/1983 Thulman et al. ..... 126/77
4,443,181 A * 4/1984 Russell ..... 431/6
4,463,687 A * 8/1984 Zimmerman et al. ..... 110/233
4,543,941 A * 10/1985 Newell ..... 126/293
4,559,882 A * 12/1985 Dobson ..... 110/254
4,606,282 A 8/1986 Steindal
4,774,931 A * 10/1988 Urso ..... 126/85 B
4,782,767 A * 11/1988 Stoner ..... 110/233
4,803,973 A * 2/1989 Harman ..... 126/73
4,825,845 A * 5/1989 Olivotti ..... 126/15 R
4,856,438 A * 8/1989 Peugh ..... 110/233
4,989,521 A 2/1991 Traeger et al.
5,123,360 A * 6/1992 Burke et al. ..... 110/233
5,133,266 A * 7/1992 Cullen ..... 110/233
5,137,010 A 8/1992 Whitfield et al.
5,144,939 A * 9/1992 Christopherson ..... 126/25 R
5,285,738 A * 2/1994 Cullen ..... 110/233
5,297,493 A * 3/1994 Nuesmeyer et al. ..... 110/233
5,357,877 A 10/1994 Nuesmeyer et al.
5,893,358 A 4/1999 Whitfield
5,983,885 A * 11/1999 Jarvi ..... 126/73
6,223,737 B1 * 5/2001 Buckner ..... 126/25 R
6,336,449 B1 1/2002 Drisdelle et al.
6,397,833 B1 6/2002 Jarvi
6,615,748 B2 * 9/2003 Sunter et al. ..... 110/233
7,069,925 B2 * 7/2006 Henry et al. ..... 126/512
7,318,431 B1 * 1/2008 Holtan et al. ..... 126/7
2004/0129262 A1 * 7/2004 Pieti ..... 126/146

* cited by examiner

GRAVITY FEED NATURAL DRAFT PELLET STOVE

CROSS-REFERENCE TO RELATED APPLICATIONS

None.

BACKGROUND OF THE INVENTION

A. Field of the Invention

The field of the present invention relates generally to fuel burning stoves and heating systems for heating the interior of a building, such as a home or office. In particular, the present invention relates to fuel burning stoves configured to efficiently and effectively burn pellets, granules or like sized solid heating fuel to provide the desired heating. Even more particularly, the present invention relates to such pellet burning stoves that have gravity feed and natural draft intake systems to provide the fuel and air to the burner.

B. Background

The high cost of heating the interior of a building using conventional, but non-renewable heating fuel sources, such as coal, heating oil, propane and the like, has led many people utilize wood burning fireplaces and stoves as the heat source, particularly for homes, shops and small offices. The basic configuration of wood burning fireplace and stove heating systems has been in use for very many years and has not significantly changed. One of the major disadvantages of standard wood burning fireplaces and stoves is that they are known to be relatively inefficient means of converting the fuel, such as wood logs, into heat. In addition, wood burning fireplaces and stoves are also known to be significant contributors to air pollution. In fact, due to air pollution concerns, many municipalities and counties ban or substantially limit the use of wood burning fireplaces on days when the air quality of the region is such that the air is unable to handle the additional emissions from these sources.

A relatively recent improvement to stove-type heating systems is the pellet burning stove. As well known by those skilled in the art, pellet burning stoves have a number of substantial benefits over the typical wood (i.e., log) burning stove or fireplace, including more efficient burning of the fuel material, less emissions and cleaner emissions. Because of these benefits and benefits with regard to fuel availability, pellet burning stoves have come into wide use. The typical pellet stove utilizes wood pellets that are comprised of by-products from the wood/lumber industry, such as limbs, leaves and other tree waste materials, that are ground, processed and then compressed into relatively small pellet-sized fuel material which are typically held together by a resin or resin-like material. In addition to the obvious benefit of more efficiently utilizing the tree and wood materials, wood pellets are somewhat easier to handle and store than conventional wood logs and the like. Other biomass materials are also known to be utilized for stove pellets. A known disadvantage of pellet fuel, in part due to the resin or other binding material utilized to hold the pellets together, is that it can be somewhat difficult to ignite and require relative high operating temperature for proper or complete combustion of the pellets.

To maintain the temperature required for sustained combustion of the pellet fuel, some pellet stoves utilize electric motor-powered fans or blowers to direct air into the stove's combustion chamber. Some pellet stoves also utilize electrically powered pellet delivery systems, for instance comprising an electric motor driven auger or the like, to direct the pellets into the combustion chamber. As is well known in the industry, the use of electrically powered fans, blowers and pellet delivery systems significantly increase the initial cost, operating cost and complexity of the pellet stove, while providing a less than desirable overall fuel efficiency. In addition, these components are known to have mechanical problems, thereby reducing the reliability of such pellet stoves as a source of heat. The reliability problems of pellet stoves having electrically powered components are compounded when the electrical supply is interrupted due to inclement weather, as happens from time to time because of blizzards or the like, resulting in the pellet stove not being useable when it is most needed. As a result of these known disadvantages, the preferred pellet stoves are those that do not require electrically operated components for combustion or fuel delivery.

Over the years, a number of heating and pellet stoves, and components therefore, have been patented. For instance, U.S. Pat. No. 659,971 to Hower describes a heating stove having a gravity fed combustion chamber that receives fuel from the fuel magazine onto a fire plate that receives draft air from a damper controlled vertical air pipe. U.S. Pat. No. 1,808,487 to Ahlber describes a heating stove or furnace having a gravity fed magazine tube that deposits fuel onto grate bars in the fire box, which receives air from a vent located to the side and below the fire box. U.S. Pat. No. 4,606,282 to Steindal describes a self-feeding wood burning stove configured to automatically feed and burn elongated, round cross-section logs. U.S. Pat. No. 4,989,521 to Traeger, et al. describes a gravity fed pellet burner stove having a hopper that gravity feeds fuel onto an inclined, channel-shaped chute, having holes thereon for air to flow through the fuel, in the burner. An adjustable opening controls the amount of air flowing through the burner.

In an attempt to improve the heating and fuel consumption efficiency of wood burning or pellet stoves, a number of patents describe heating systems that utilize mechanical fuel delivery and forced air apparatuses to deliver fuel and air into the burning chamber. For instance, U.S. Pat. No. 5,893,358 to Whitfield describes a pellet fuel burner having an auger that pushes fuel through a feed conduit onto a burner grate in the firebox, where combustion air is received from a blower through an air manifold. The feed conduit vertically deposits the fuel onto the burner grate. U.S. Pat. No. 6,223,737 to Buckner describes a fuel burning device, configured as a cooking grill, that utilizes an auger to deliver fuel from the hopper to the burner and a blower to provide air for combustion. U.S. Pat. No. 6,336,449 to Drisdelle, et al. describes a solid fuel burner that receives fuel from a hopper by an auger-driven apparatus. Air for the combustion in the burner is provided through a tube and discharged from the burner through a vent by use of an air discharge fan.

Improved natural draft, automatic feed pellet stoves are disclosed in U.S. Pat. Nos. 5,983,885 and 6,397,833 to Jarvi. The stove in these patents stores pellet fuel in a hopper having a discharge slot disposed above one end of a sloped grate. Air for the combustion process is provided to the underside of the grate through an air intake or draft pipe, having a damper thereon, that naturally draws in air from air inlet. The pellets are discharged from the slot onto one end of the sloped grate so that combustion of the fuel takes place as the pellets roll over the grate. Ash from the combustion falls through the grate onto an ash collection pan at the bottom of the firebox.

Although the foregoing patents describe stoves and heaters that are configured to burn pellet fuel, there exists a need for an improved pellet stove that is more efficient at burning pellet fuel and heating the interior of a building. What is needed is pellet stove that is configured to more efficiently burn pellet fuel utilizing natural draft air, thereby eliminating the need for electric blowers and the like to provide combustion air. Additionally, there is a need for such an improved efficiency stove that utilizes a gravity feed system so as to eliminate the necessity of augers or other electrically operated fuel delivery apparatuses. The preferred gravity feed, natural draft pellet stove should effectively and efficiently burn the pellet fuel so as to substantially minimize the amount of particulate matter and other harmful matter in its exhaust emission. In addition to reduced air pollution emissions, the preferred pellet stove will more efficiently provide heat to the interior of the building relative to the amount of fuel consumed thereby. The preferred pellet stove should be able to accomplish the above and be relatively inexpensive to manufacture, simple to operate and comprise few moving components so as to reduce the likelihood of mechanical breakdown.

SUMMARY OF THE INVENTION

The gravity feed, natural draft pellet stove of the present invention provides the benefits and solves the problems identified above. That is to say, the present invention discloses a pellet stove that effectively and efficiently burns pellet fuel without the need for electrically-driven augers and blowers to deliver fuel and air to the combustion chamber. The pellet stove of the present invention more efficiently and completely burns the pellet fuel so as to substantially reduce the amount of particulate and other harmful matter in its exhaust emissions, thereby allowing use of the stove in areas and on days when air pollution levels prevent the burning of other types of wood stoves. The pellet stove of the present invention accomplishes the above while efficiently utilizing the fuel to heat the interior of the building in which is located. The present gravity feed, natural draft pellet stove is relatively inexpensive to manufacture and easy to use. Due to the lack of moving components, the present pellet stove is very reliable and, as such, cost effective to operate. The preferred embodiment of the present pellet stove utilizes a removable and interchangeable combustion chamber to provide for different heat output by the pellet stove and to allow cleaning of the burn chamber. The advantages of the present pellet stove are adaptable to a variety of different pellet stove configurations, including more "art" type of configurations than presently available pellet stoves.

In one aspect of the present invention, the gravity feed, natural draft pellet stove has a vent tube with a first end that defines a primary combustion area and a second end that attaches to or is integral with an exhaust pipe that transmits the exhaust out of the structure where the pellet stove is being utilized to heat the interior thereof. The vent tube has a top side with an upper vent feed opening and a bottom side with a lower vent feed opening. A feed tube extends generally upwardly from the top side of the vent tube to define a fuel chamber disposed above the upper vent feed opening. The primary combustion area comprises a burn unit having a first end, a second end and a pellet receptacle disposed therebetween. The pellet receptacle has side walls and a bottom wall, with at least the bottom wall having one or more receptacle openings, that define a primary burn chamber. In the preferred embodiment, the burn unit is removably disposed in the first end of the vent tube and the pellet receptacle is removably disposed in a receptacle support area of the burn unit so the user may remove the burn unit and the pellet receptacle for cleaning, replacement and/or resizing. The burn unit is disposed inside the first end of the vent tube such that the primary burn chamber is disposed between the upper and lower vent openings in the vent tube. A pellet fuel feeding mechanism feeds pellet fuel into the fuel chamber in the feed tube. In the preferred embodiment, the feeding mechanism comprises a storage bin that is attached to, directly or indirectly, the feed tube so as to gravity feed pellet fuel to the fuel chamber through an opening in a side wall of the feed tube. A secondary combustion area is disposed below the primary combustion area to receive and further burn pellet fuel from the primary burn chamber. In a preferred embodiment, the secondary combustion area comprises a burn box attached to or integral with the bottom side of the vent tube below the lower vent feed opening. The burn box defines a secondary burn chamber and has one or more air openings for receiving air into the secondary combustion area and, through the lower vent feed opening and receptacle openings, into the primary burn chamber. A closing mechanism at the first end of the vent tube closes the first end once the burn unit is disposed inside. In the preferred embodiment, the closing mechanism is attached to or integral with the trailing end of the burn unit and is configured to position the primary burn chamber below the lower vent feed opening. An ash tray below the burn box receives ash from the secondary burn chamber through one or more ash openings on the bottom side of the burn box. Also in the preferred embodiment, the vent tube has one or more vent openings and a mechanism for controlling whether the vent openings are open, closed or the extent which they are partially opened so as to control the draft of the air drawn into the primary and secondary burn chambers.

In use, pellet fuel is placed in the storage bin and falls, by gravity, to the fuel chamber in the vent tube and then into the primary burn chamber through the upper vent feed opening. The user lights the pellet fuel in the primary fuel chamber with a gas torch or other substantial flame. Once this pellet fuel is lit, the pellet stove of the present invention provides for natural draft by drawing in air through the air openings on the burn box and then into the secondary and primary burn chambers to provide the air for combustion. The vent openings provide a venturi effect that draws the exhaust upward through the vent tube, to the exhaust pipe and then out the structure. As the pellet fuel in the primary burn chamber burns, some of the pellet fuel in the fuel chamber directly above will fall into the primary burn chamber to replenish the fuel there. As this fuel moves downward into the primary burn chamber, additional pellet fuel will fall from the storage bin into the fuel chamber. Because of the vertical fuel path, which provides the gravity feed, the flame will not burn up into the fuel chamber or storage bin. Once the pellet fuel in the primary burn chamber substantially burns, it falls through the receptacle openings on the bottom of the pellet receptacle into the secondary burn chamber where it further burns before falling as ash into the ash tray below. As such, the pellet stove of the present invention more effectively and efficiently burns pellet fuel and does so in a manner that substantially reduces the amount of air pollution generated by its exhaust and with a relatively small amount of ash as solid waste.

Accordingly, the primary objective of the present invention is to provide a gravity feed, natural draft pellet stove that provides the advantages discussed above and overcomes the disadvantages and limitations which are associated with presently available pellet stoves.

An important objective of the present invention is to provide a pellet stove that has a gravity feed system for delivering pellet fuel to the burn chamber to eliminate the need for electrically-driven augers or like devices to deliver the pellet fuel.

It is also an important objective of the present invention to provide a pellet stove that relies on natural draft to supply the air necessary for efficient and effective combustion of the pellet fuel so as to eliminate the need for electrically-driven blowers and like devices.

It is also an important objective of the present invention to provide a pellet stove that combines the features of gravity feed and natural draft while achieving virtually complete combustion of the pellet fuel so as to substantially reduce the amount of particulate or other harmful matter in the emissions exhausted from the pellet stove.

It is also an important objective of the present invention to provide a pellet stove that accomplishes the above objectives while efficiently heating the interior of a house, office or other building.

It is also an important objective of the present invention to provide a gravity feed, natural draft pellet stove that efficiently and effectively burns the pellet fuel to heat an interior space and reduce harmful emissions and which is relatively inexpensive to manufacture, easy to use and cost effective to operate.

It is also an important objective of the present invention to provide a gravity feed, natural draft pellet stove that has a removable burn chamber to allow cleaning thereof and is adaptable to use of interchangeable burn chambers so the user may achieve different temperature output from the same pellet stove.

The above and other objectives of the present invention will be explained in greater detail by reference to the attached figures and the description of the preferred embodiment which follows. As set forth herein, the present invention resides in the novel features of form, construction, mode of operation and combination of processes presently described and understood by the claims.

BRIEF DESCRIPTION OF THE DRAWINGS

In the drawings which illustrate the preferred embodiments and the best modes presently contemplated for carrying out the present invention.

DETAILED DESCRIPTION OF THE PREFERRED EMBODIMENTS

Figure 1:
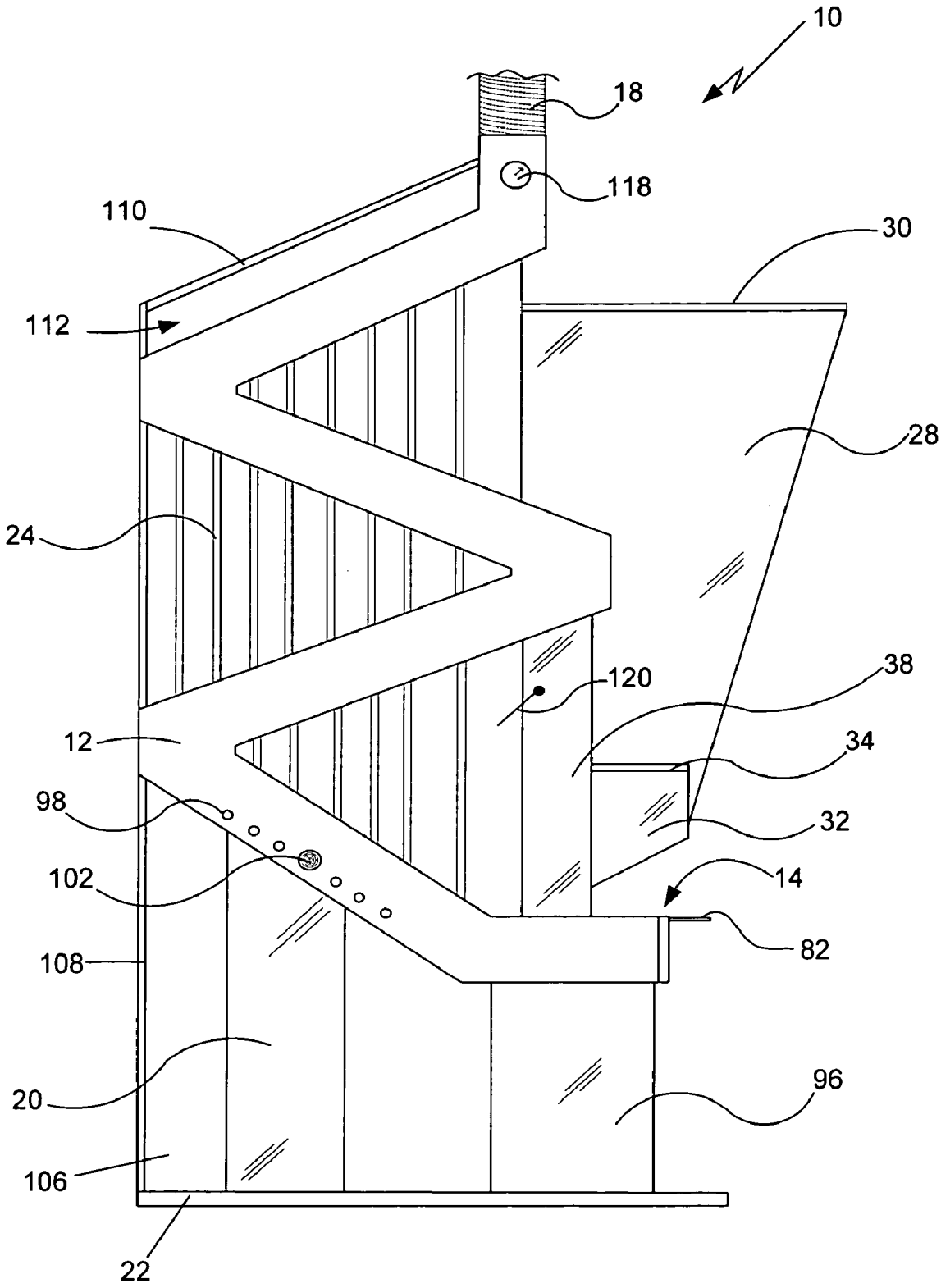
FIG. 1 is a front elevation view of a gravity feed natural draft pellet stove configured according to a preferred embodiment of the present invention, showing the fuel storage and transfer bins, the air vent tube and the structural support members.

With reference to the figures where like elements have been given like numerical designations to facilitate the reader's understanding of the present invention, the preferred embodiments of the present invention are set forth below. As is understood by those skilled in the art, the enclosed figures and drawings are merely illustrative of a preferred embodiment and represents one of several different ways of configuring the present invention. Although specific components, materials, configurations and uses are set forth below and illustrated in the drawings, it should be understood that a number of variations to the components and to the configuration of those components described herein and in the accompanying figures can be made without changing the scope and function of the invention set forth herein. For purposes of this disclosure, references are generally to use of the pellet stove to heat the interior space of a house, office or other building, however, it is understood that the disclosure herein may apply to other types of uses where a pellet stove can beneficially be utilized to provide heat.

A gravity feed, natural draft pellet stove that is manufactured out of the components and configured pursuant to a preferred embodiment of the present invention is shown generally as 10 in the figures. As shown in FIGS. 1 through 7, pellet stove 10 generally comprises an elongated vent tube 12 having a first end 14 and a second end 16 configured, as explained in more detail below, to transfer ambient, non-pressurized air from near first end 14, through the fuel combustion chamber and out the exhaust pipe or tube 18 attached to second end 16. Exhaust tube 18 will typically connect to the roof or a wall of the structure in which pellet stove 10 is utilized so as to direct the exhaust from pellet stove 10 to the atmosphere. In the configuration shown in FIG. 1, vent tube 12 is provided in a sideways "W" shape that is supported by one or more vertical support members 20 above base 22, which will typically rest on the floor of the home, office or other structure where heating is desired. Vertical support members 20 must be sized and configured to safely support the weight of the components of pellet stove 10. Base 22 should be sized and configured to safely support pellet stove 10 in a manner that substantially minimizes the risk of, or prevents, tipping over of pellet stove 10. A plurality of heat members 24 interconnect the angled sections of vent tube 12 which form the "W" shape, as shown in FIG. 1. Although heat members 24 can be utilized to support vent tube 12 so as to maintain pellet stove 10 in the desired upright position, the primary purpose of heat members 24 is for heat convection and conduction so as to improve the heat output of pellet stove 10. Preferably, the materials chosen for vent tube 12 and heat members 24 facilitates heat members 24 absorbing heat from vent tube 12 and transmitting heat to the surrounding air. In one embodiment of making pellet stove 10 of the present invention, vent tube 12 is manufactured out of square tube steel stock that is cut, folded and then welded into the desired shape and heat members 24 are made out of flat strips of steel strapping material. A variety of other materials, metal and non-metal, and material configurations will also be suitable for vent tube 12 and heat members 24. As will be recognized and appreciated by those skilled in the art, pellet stove 10 of the present invention can have vent tube 12 made into a wide variety of different shapes and still function according to the principles set forth herein. This will allow various alternative "art" or decorative configurations that heretofore have not been available or practical for wood pellet burning stoves.

Figure 2:
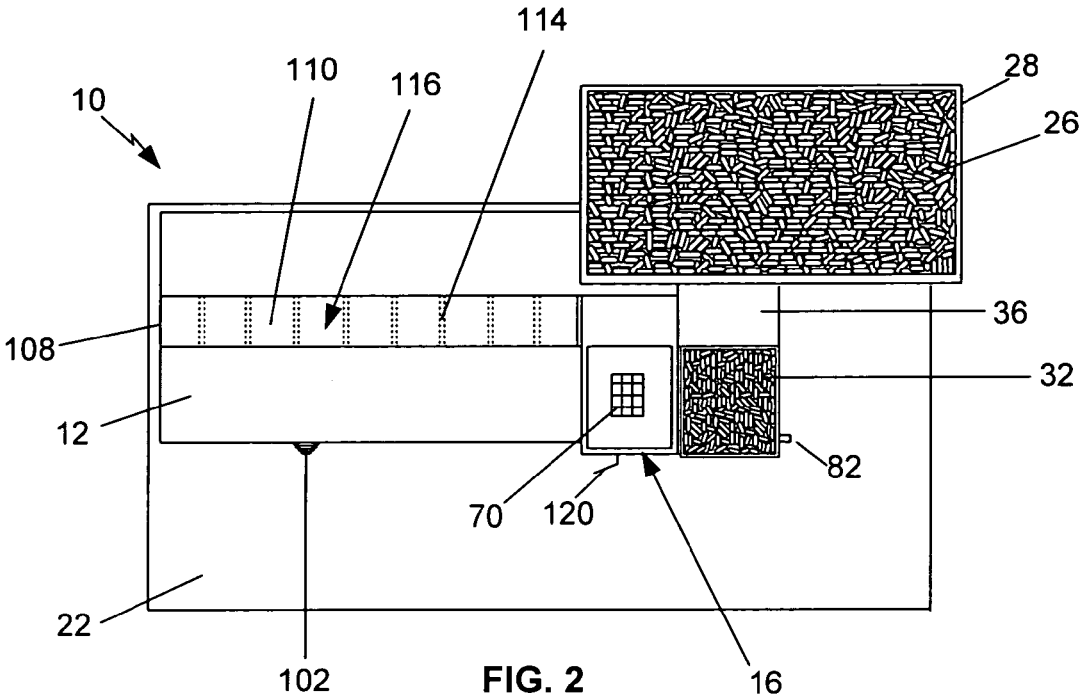
FIG. 2 is a top plan view of the pellet stove of FIG. 1 showing the exhaust opening and heat transfer spacer members (hidden lines) with the lids to the storage bin and transfer bin removed in order to show the pellet fuel in the storage and transfer bins.
Figure 7:
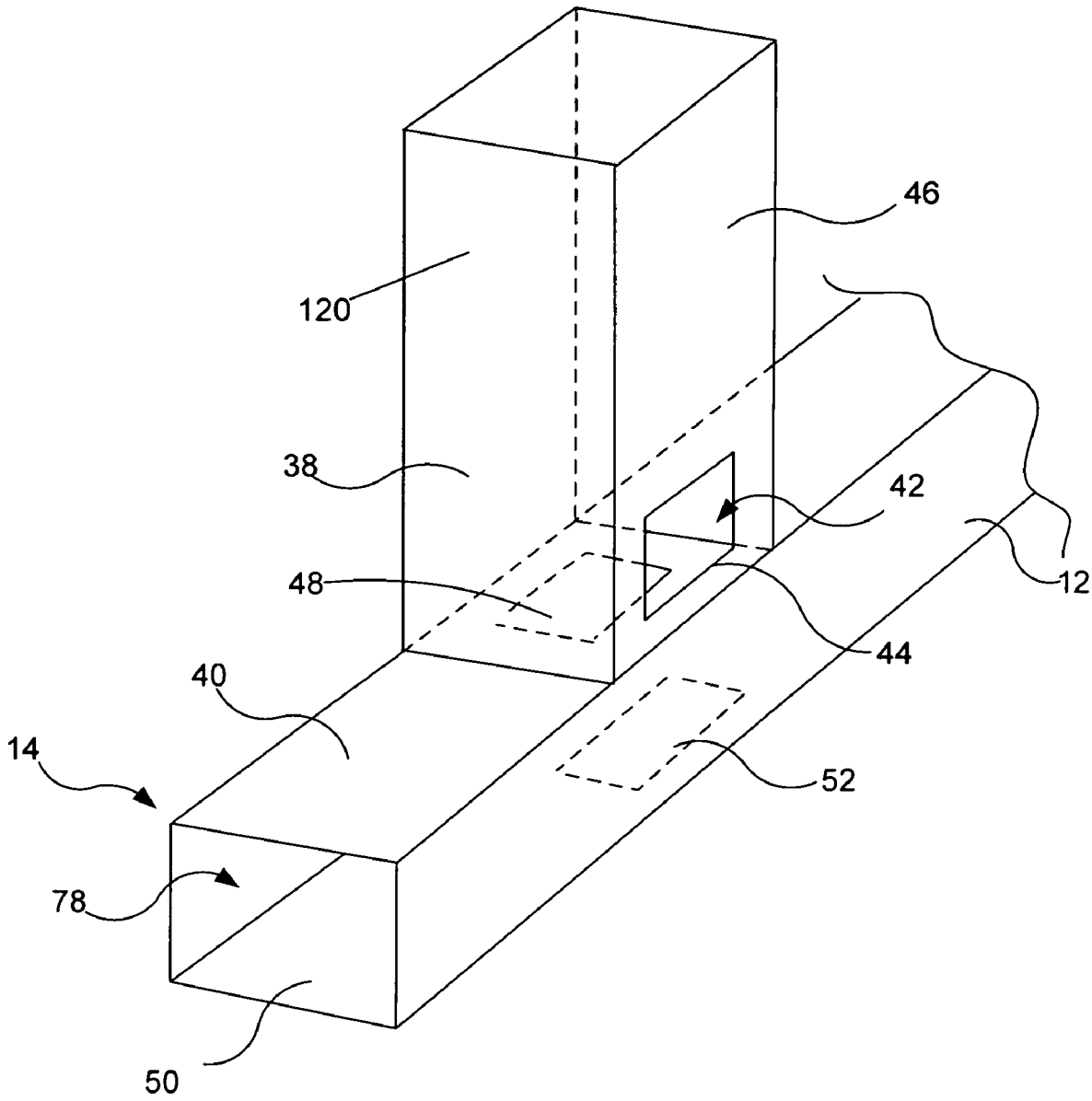
FIG. 7 is a partial view of the feed tube extending upwardly from the vent tube with the transfer bin removed to show the various openings that allow movement of the pellet fuel to the combustion areas.

In the preferred embodiment of the present invention, pellet stove 10 is configured to burn commonly available wood pellet fuel, shown as 26 in FIG. 2. Typically, this fuel is made from wood, wood scrap material and a binding agent to hold the wood products together in a pellet or pellet-like shape. In a preferred embodiment, pellet fuel 26 is initially received and stored in fuel storage bin 28 having a top plate or lid 30 covering the fuel pellets 26 in FIG. 1 and shown removed to expose the fuel pellets 26 in FIG. 2. The pellet stove 10 of FIG. 1 also has a fuel transfer bin 32 having a top plate or lid 34 covering the fuel pellets in FIG. 1 and shown removed to expose the fuel pellets 26 in FIG. 2. Feed conduit 36 interconnects fuel storage bin 28 and fuel transfer bin 32 to move pellet fuel 26 to feed tube 38 attached to the top side 40 of vent tube 12 and extending generally upwardly therefrom, as best shown in FIG. 7. The bottom section of feed tube 38, at top side 40, defines fuel chamber 42 in which pellet fuel 26 is received from transfer bin 32 through feed tube opening 44 on the side 46 of feed tube 38 adjacent to transfer bin 32. As best shown in the partial side elevation view of FIG. 3 and the partial front elevation view of FIG. 4, pellet fuel 26 will fall downward by the force of gravity from storage bin 28 through feed conduit 36 to transfer bin 32 and then to fuel chamber 42 through feed tube opening 44, following the fuel path indicated by the letter "F" thereon. As explained in more detail below, pellet fuel 26 will then fall into the combustion area of pellet stove 10 where it will be consumed to generate heat.

The top side 40 of vent tube 12 under fuel chamber 42 is provided with upper vent feed opening 48 and the bottom side 50 of vent tube 12 is provided with lower vent feed opening 52, as shown in FIG. 7. Pellet fuel 26 from fuel chamber 42 falls through upper vent feed opening 48 into the primary combustion area, shown generally as 54 in FIGS. 3 and 4, and then falls through lower vent feed opening 52 into the secondary combustion area, shown generally as 56. The primary combustion area 54 includes burn unit 58, shown in place (hidden lines) in FIG. 4 and isolated in FIG. 5, that has a first end 60 and a second end 62. In a preferred embodiment, burn unit 58 comprises a first tubular section 64 towards first end 60, a second tubular section 66 towards second end 62 and a receptacle support section 68 interconnecting the first 64 and second 66 tubular sections. Receptacle support section 68 is sized and configured to support the cage-like pellet receptacle 70 comprising a plurality of frame members 72 and forming a plurality openings 74 on the sides (shown in FIG. 5) and bottom (shown in FIG. 2) of pellet receptacle 70. The sides and bottom of pellet receptacle 70 define a primary burn chamber 76 in which pellet fuel 26 undergoes combustion in the primary combustion area 54. Preferably, the top of pellet receptacle 70 is completely open so as to not obstruct the movement of pellet fuel 26 into primary burn chamber 76.

First 64 and second 66 tubular sections are sized and configured to fit within vent tube 12 in a manner that places pellet receptacle 70 directly below upper vent feed opening 48 on the top side 40 of vent tube 12 and above lower vent feed opening 52 on the bottom side 50 of vent tube 12. As such, pellet receptacle 70 will be placed directly under fuel chamber 42 of feed tube 38 such that pellet fuel 26 from fuel chamber 42 will fall substantially vertically into the primary burn chamber 76 of pellet receptacle 70. In this configuration, as pellet fuel 26 is consumed in primary burn chamber 76, the generally consumed portion of pellet fuel 26 will fall down through the bottom of pellet receptacle 70, through lower vent feed opening 52 in the bottom side of vent tube 12 and into the secondary combustion area 54, where further combustion takes place so as to substantially consume all of the pellet fuel 26. As the substantially consumed portion of pellet fuel 26 falls into secondary combustion area 56, it will make room for additional "fresh" pellet fuel 26 to move from fuel chamber 42 into primary burn chamber 76. In this manner, pellet stove 10 of the present invention utilizes gravity feed to be self-feeding, thereby eliminating the need for electrical pellet feed mechanisms that are common in some prior art pellet stoves. In addition, the configuration of the primary combustion area 54 prevents the flame burning back into the fuel chamber 42 and bins 28 and 32.

In a preferred embodiment, shown in the figures, burn unit 58 is removably received in vent tube 12 through the tubular opening 78 at the first end 14 thereof. In the embodiment shown, first end 60 of burn unit 58 is enlarged so that when first 64 and second 66 tubular sections are disposed within first end 14 of vent tube 12, the first end 60 of burn unit 58 will engage the outer edge of first end 14, thereby positioning pellet receptacle 70 directly under upper vent feed opening 48 and above lower vent feed opening 52. First end 60 of burn unit 58 is also configured to substantially close or seal off tubular opening 78 when burn unit 58 is in place inside vent tube 12. A closure mechanism 80 is utilized to allow the user to selectively open or close the first end 60 of burn unit 58. In the embodiment shown in the figures, closure mechanism 80 comprises a guillotine-type valve (not shown) having a handle 82 that is attached to a slide member (also not shown) slidably disposed relative to first end 60 of burn unit 58. In an alternative embodiment, closure mechanism 80 comprises a flapper-type valve (also not shown). Those skilled in the art will readily appreciate that a variety of different configurations are suitable for closure mechanism 80 so as to achieve the objectives set forth herein. As explained in more detail below, closure mechanism 80 remains in the closed position when burn unit 58 is disposed in vent tube 12 except when the user operates handle 82 to open the guillotine-type valve of closure mechanism 80 to insert a torch or other lighting device to initiate combustion of the pellet fuel 26 in burn chamber 76 when pellet stove 10 is "off" or non-burning. Once lit, the closure mechanism 80 closes first end 60 of burn unit 58. The pellet fuel 26 in burn chamber 76 will continue to burn until there is no pellet fuel 26 remaining. In an alternative configuration, not shown, the closure mechanism 80 is attached to the first end 14 of vent tube 12 instead of the first end 60 of burn unit 58. In either of these configurations, the burn unit 58 should be appropriately sized and configured to position pellet receptacle 70 and burn chamber 76 substantially between the upper vent feed opening 48 and the lower vent feed opening 52 so the pellet fuel 26, following fuel path F, will be allowed to fall from fuel chamber 42 to primary burn chamber 76 of the primary combustion area 54 and then on to the secondary combustion area 56.

Unlike prior art pellet stoves, the pellet stove 10 of the present invention allows the user to remove, clean and/or change the components that make up the primary combustion area 54, specifically burn unit 58 and pellet receptacle 70 therein. The ability to remove and clean or replace these components provides a significant improvement over prior art pellet stoves. As is known in the art, the burning of pellet fuel 26 will result in some residue from the wood materials and, to a greater extent, the bonding agent(s) utilized to hold these materials together. This residue can result in partial or complete blocking of the openings 74 in the sides and bottom of pellet receptacle 70, which will impede or prevent the movement of pellet fuel 26 to the secondary combustion area 56 and the movement of air through the primary combustion area 54, thereby reducing the efficiency of pellet stove 10 and, in the more severe situation, its operation altogether. Pellet stove 10 allows the user to operate handle 82 to open closure mechanism 80 and remove burn unit 58. In most circumstances, burn unit 58 itself will be suitable for reuse with little or no cleaning or replacement of components. Depending on the cost and other circumstances, the user can remove the cage-like pellet receptacle 70 from burn unit 58 and clean or replace it with a new pellet receptacle 70 by, in a preferred embodiment, merely dropping the new pellet receptacle 70 in the receptacle support 68 of burn unit 58 and then reinserting burn unit 58 back into the first end 14 of vent tube 12. In an alternative embodiment, depending on the component materials and costs, pellet receptacle 70 can be fixedly attached or integral to burn unit 58 and the user cleans or replaces the entire burn unit 58.

Another primary benefit of the removable burn unit 58, having either the replaceable or integral pellet receptacle 70, is that this allows the user to change the size and/or configuration of pellet receptacle 70 so that it holds more or less pellet fuel 26 in primary burn chamber 76. This is also a significant improvement over prior art pellet stoves. As will be understood by those skilled in the art, the size of primary burn chamber 76 and the amount of pellet fuel 26 subject to combustion therein substantially affects the amount of heat generated by pellet stove 10. Increasing the size of the primary burn chamber 54 to hold more pellet fuel 26 will generate more heat and decreasing the size will generate less heat, with all other factors held constant (i.e., air flow, type of pellet fuel 26, etc.). In addition, the shape or other configuration of pellet receptacle 70 and the primary burn chamber 76 therein will affect the rate at which pellet fuel 26 is burned and falls through to the secondary combustion area 56. Depending on the size of the individual pellets of pellet fuel 26, pellet receptacle 70 will have to be selected based on the size of openings 74 therein to prevent pellet fuel 26 from prematurely (i.e., before it is sufficiently burned) falling through burn unit 58 to the secondary combustion area 56.

Burn unit 58 can be made out of a variety of materials, including such metals as steel, stainless steel and the like. Although pellet receptacle 70 also can be made out of steel, it is preferred that it be made out of materials that are better able to withstand the high temperatures that will be achieved in the primary burn chamber 76, such as ceramic, stainless steel and certain composite materials. In one configuration, the present inventor has measured temperatures of between 260° F. and 480° F. at temperature gauge 118 (shown in FIGS. 1 and 8). Much higher temperatures will be realized at primary burn chamber 54. The choice of materials for pellet receptacle 70 will affect the life thereof, requiring more or less replacement by the user.

Figure 3:
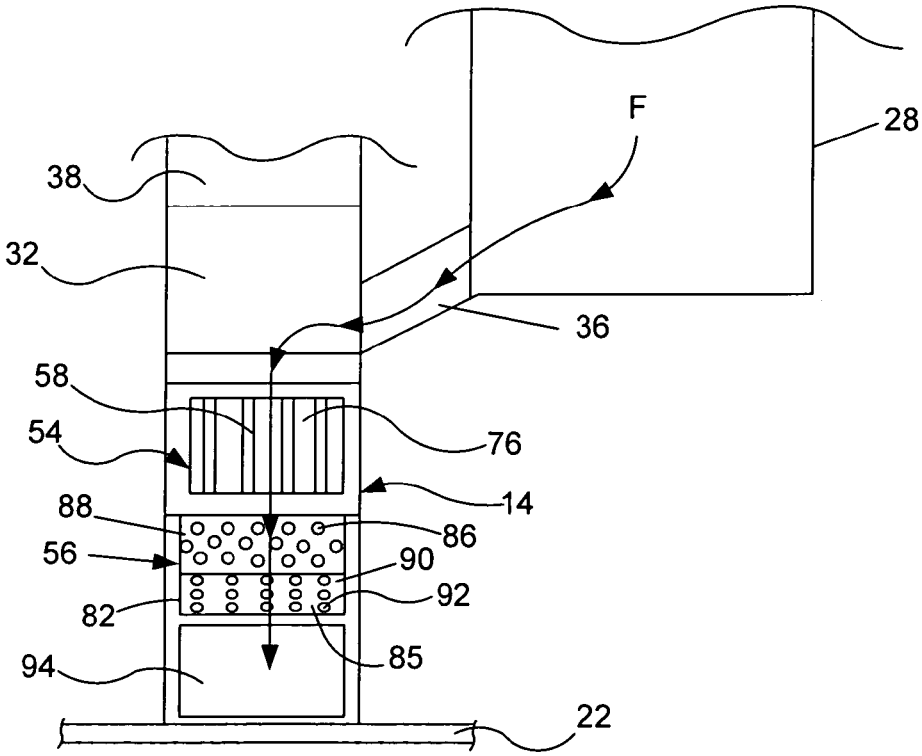
FIG. 3 is a partial side elevation view of the pellet stove of FIG. 1, showing the fuel path to the primary burn chamber, the secondary burn chamber and the ash storage tray.
Figure 4:
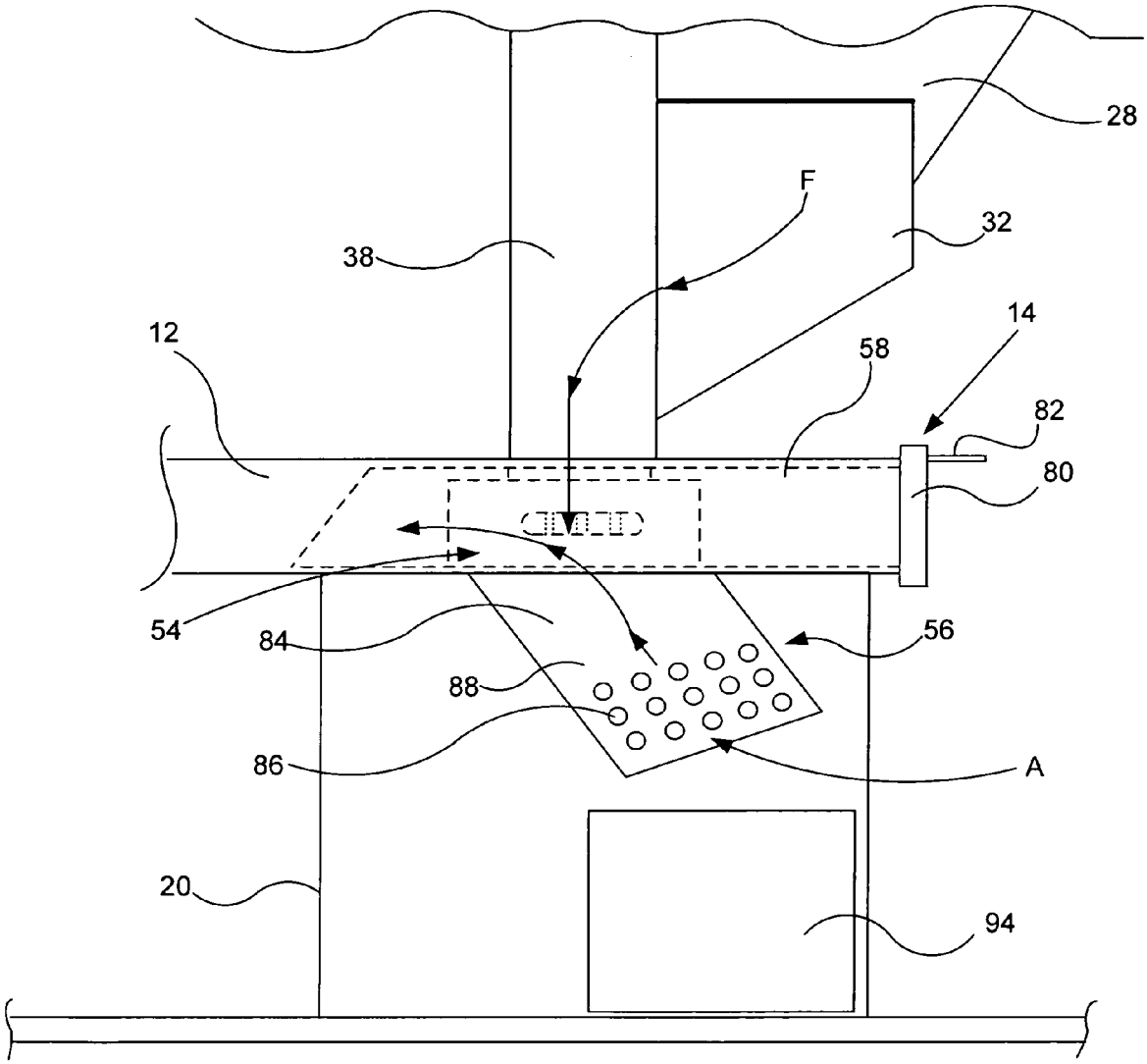
FIG. 4 is a partial front elevation view of the pellet stove of FIG. 1, showing the fuel path to the primary burn chamber in the air vent tube with the lower cover removed to show the secondary burn chamber and ash tray.
Figure 5:
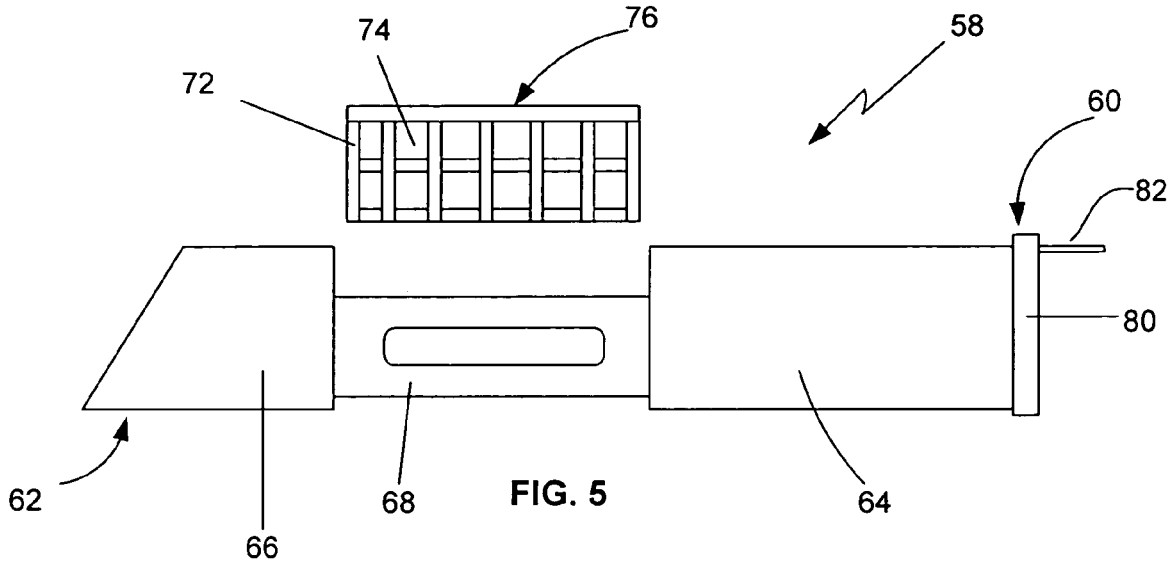
FIG. 5 is a side view of the primary burn chamber of the pellet stove of FIG. 1 shown removed from the pellet stove and the primary fuel holder separated from the primary burn chamber.

In the preferred embodiment of the pellet stove 10 of the present invention, secondary combustion area 56 comprises a burn box 84 attached to or integral with the bottom side 50 of vent tube 12 substantially at or below the lower vent feed opening 52. The interior of burn box 84 defines secondary burn chamber 85 therein that receives partially burned pellet fuel 26 from the primary combustion area 54, which falls through pellet receptacle 70 and lower vent feed opening 52 into burn box 84, for further combustion. Although the pellet fuel 26 that falls through to secondary burn chamber 85 of burn box 84 will be substantially consumed in primary burn chamber 76, additional burning will take place in burn box 84 so as to more fully consume this material. Burn box 84 is configured with a plurality of air openings 86 on its side walls 88, as shown in FIGS. 3 and 4. The plurality of air openings 86 on the side walls 88 of burn box 84 are configured to facilitate air being drawn into burn box 84 of secondary combustion area 56 and the primary combustion area 54 along the air path, shown as A in FIG. 4. The bottom wall 90 of burn box 84, shown in FIG. 3, has a plurality of ash openings 92 configured to allow the fully combusted pellet fuel 26, in the form of ash, to fall through to ash tray 94. The ash openings 92 on the bottom wall 90 of burn box 84 should be configured to substantially prevent unconsumed pellet fuel 26 from falling through to ash tray 90. Properly sized and configured, very little ash is generated from the burning of pellet fuel 26 in pellet stove 10 of the present invention. In one configuration, the bottom wall 90 of burn unit 84 is removable from burn unit 84 so that it can be periodically cleaned by the user or someone on his or her behalf to prevent the undesirable build-up of pellet residue thereon, which could impede or even prevent the ash from falling through to ash tray 94.

As shown in the figures, ash tray 94 can be a box, box-like or tray component that rests on base 22 of pellet stove 10 and is removable therefrom for disposing of the ash as needed. In one embodiment, as shown in FIG. 1, a cover plate 96 is placed against the front side of vertical support member 20 below the first end 14 of vent tube 12 to protect users from contact against burn unit 84. As shown in FIG. 3, the side is preferably left open to allow air to easily flow into burn unit 84 and to facilitate removal of ash tray 94. Alternatively, the side can also be closed off if provision is made for sufficient air to flow into pellet stove 10 and for the removal of ash tray 94 therefrom.

Figure 6:
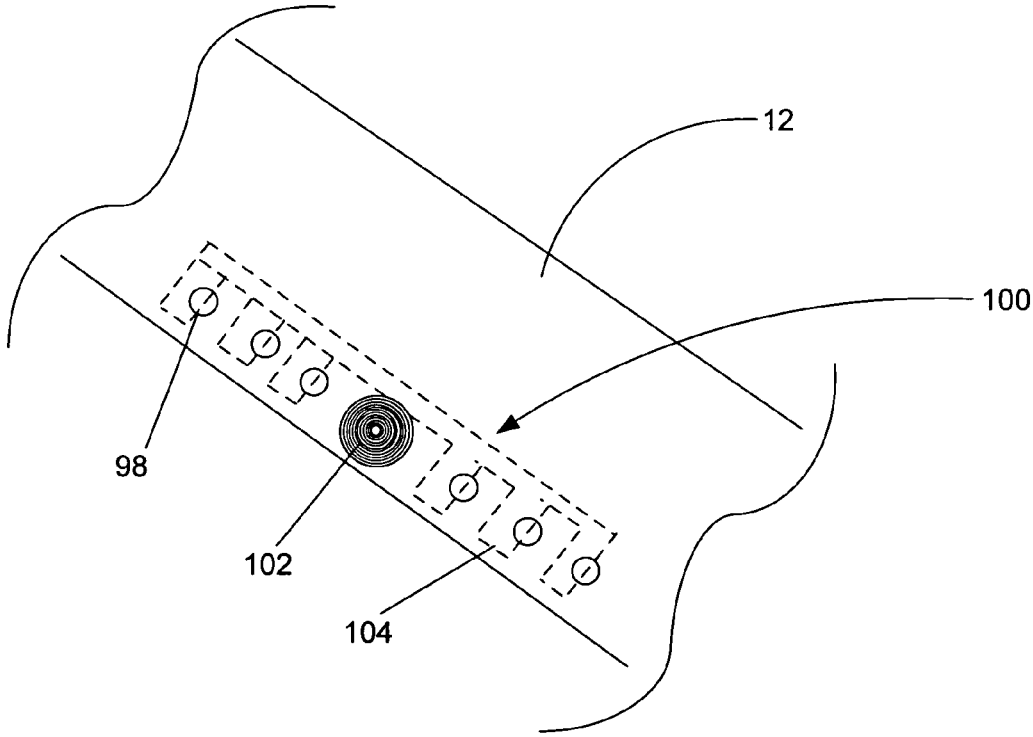
FIG. 6 is an isolated side view of the air flow vents and air control mechanism of the pellet stove of FIG. 1.

As set forth above, the pellet stove 10 of the present invention utilizes natural draft, generated by the burning of pellet fuel in the primary 54 and secondary 56 combustion areas, to provide sufficient air for combustion. To further facilitate the draw of air into the combustion areas 54 and 56, the pellet stove 10 also comprises one or more vent openings 98 on the side wall of vent tube 12 downstream of the primary combustion area 54, as shown on FIG. 1. Preferably, a plurality of vent openings 98 are utilized. Although vent openings 98 can be fixed open, it is preferred that pellet stove 10 be configured to allow the user to control the amount of the opening of vent openings 98 so that he or she may control the drawing of air into primary 54 and secondary 56 combustion areas along air path A. In a preferred embodiment, the amount that vent openings 98 are opened is regulated by vent control mechanism 100, which is configured to selectively fully open, fully close or open/close therebetween vent openings 98. In one embodiment, vent control mechanism 100 comprises vent knob 102 that is operatively connected to slide member 104 that moves behind the vent openings 98 to open or close them, as shown in FIG. 6. As is known by those skilled in the art, fully closed vent openings 98 will draw the most air into and through primary 54 and secondary 56 combustion areas (i.e., primary burn chamber 76 and burn box 84) and generate more heat from pellet stove 10 due to a venturi-type of effect. Fully open vent openings 98 will reduce the drawing of air and, thereby, lower the heat output by pellet stove 10. As such, vent knob 102 should be easily accessible and easy for the typical user to operate. As known to those skilled in the art, numerous different configurations are possible for vent control mechanism 100 that are operatively and/or functionally equivalent to that shown in the figures.

To further improve the heating efficiency of pellet stove 10 of the present invention, back plate 106 extends from base 22 to the second end 16 of vent tube 12 across the back side of vent tube 12, as shown in FIG. 1. Back plate 106, which can be made out of sheet metal, has side extension 108 and top extension 110, which forms heated air channel 112 behind vent tube 12. Because of air convection, the heated air around vent tube 12 of pellet stove 10 will rise upward behind vent tube 12 in the space created by back plate 106 and side extension 108 until it hits top extension 110, where it will be directed or discharged outward from heated air channel 112 towards the front of pellet stove 10 into the room where pellet stove 10 is being utilized. To further improve the convection of heated air from pellet stove 10, a plurality of fin members 114, shown in FIG. 2, can be utilized to interconnect the back side of vent tube 12 with back plate 106. As shown, fin members 114 are configured to form a plurality of vertical air flow channels 116 behind vent tube 12. The vertical air flow channels 116 will further facilitate the movement of heated air upwards behind vent tube 12 and out heated air channel 112. Preferably, fin members 114 are made out of a heat conductive material so that they will become heated from vent tube 12 and be able to transfer their heat to the air flowing up vertical air flow channels 116 and out heated air channel 112, thereby increasing the heat output efficiency of pellet stove 10.

If desired, a temperature gauge 118 or the like can be provided on vent tube 12, such as at second end 16 thereof as shown in FIG. 1, to allow the user to monitor the temperature of the air flow through vent tube 12. The preferred embodiment of pellet stove 10 of the present invention also facilitates self-cleaning of the fuel chamber 42 inside feed tube 38. As shown in FIG. 1, a cleaning handle 120 can be operatively connected to a flapper-type valve, not shown, to allow or prevent the flow of air up feed tube 38. In the normal position, the flapper valve mechanism closes off feed tube 38 so air is not allowed to flow up feed tube 38. When the user desires to clean fuel chamber 42, which will generally need to be done periodically due to the materials utilized for pellet fuel 26, he or she operates cleaning handle 120 to open the flapper valve mechanism to permit air to flow up feed tube 38. Because the air will be coming directly from primary burn chamber 76, it will be very hot. This heated air will burn off any residue on the inside walls of feed tube 38, particularly fuel chamber 42, thereby being essentially self-cleaning.

In use, the user raises lid 30 and places a quantity of pellet fuel 26 in storage bin 28. Some of the pellet fuel will fall or flow by gravity through feed conduit 36 to transfer bin 32 and then to fuel chamber 42 through feed tube opening 44 on the side 46 of feed tube 38. A portion of this pellet fuel 26 will fall from fuel chamber 42 into pellet receptacle 70 in receptacle support 68 of burn unit 58. The pellet fuel 26 in pellet receptacle 70 will "back-up" or prevent further downward movement of pellet fuel 26. The user initiates combustion to obtain heat from pellet stove 10 by operating handle 82 to open closure mechanism 80 and then inserting an ignition device into tubular opening 78 of first end 14 of vent tube 12 and igniting the pellet fuel 26 in pellet receptacle 70. As those familiar with pellet stoves will know, the user must utilize a lighting device of suitable flame intensity in order to light pellet fuel 26. A hand-held torch or the like is typically able to provide the necessary flame intensity, whereas the standard cigarette lighter or butane fireplace lighter is not.

Once the pellet fuel 26 in pellet receptacle is lit, the user removes the lighting device from vent tube 12 and allows closure mechanism 80 to close or, if necessary, closes closure mechanism so as to close first end 14 of vent tube 12. The initial burning of the pellet fuel 26 in pellet receptacle will start drawing in air via a natural draft along air path A. As air is being drawn in from below (i.e., through the air openings 86 on the side walls 88 of burn box 84) to increase combustion of pellet fuel 26 in the primary burn chamber 76 of pellet receptacle 70, the user can operate vent knob 102 to move slide member 104 so as to more open or close vent openings 98 to decrease or increase the air flow draw along air path A. As the pellet fuel 26 in primary burn chamber 76 burns, the substantially burned portion of pellet fuel 26 will fall through openings 74 in the bottom of pellet receptacle 70 into secondary burn chamber 85 of burn box 84, where it will undergo a secondary burning to more fully and efficiently utilize pellet fuel 26. After the additional burning in secondary burn chamber 85, the ash material that is left will fall through the ash openings 92 on the bottom wall 90 of burn box 84. As the pellet fuel 26 in primary burn chamber 76 of pellet receptacle 70 is consumed, the pellet fuel 26 in fuel chamber 42 above primary burn chamber 76 will fall down into primary burn chamber 76 to be consumed as described above, thereby achieving a gravity feed system that does not require any mechanical mechanism to feed pellet fuel 26. The exhaust from the burning of pellet fuel 26 in primary burn chamber 76 and secondary burn chamber 85 will flow through vent tube 12 towards exhaust tube 18 and out to the atmosphere. As vent tube 12 heats up from the flow of hot air through the interior thereof, it will heat the ambient air around vent tube 12, including the air behind vent tube 12. As the air is heated, it will rise behind vent tube 12 until it exits heated air channel 112 into the room where pellet stove 10 is being utilized. The heated fin members 114 will further heat the air flowing in vertical air flow channels 116, further increasing the heated air output from heated air channel 112.

To "turn off" pellet stove 10, the user interrupts the supply of pellet fuel to fuel chamber 42 and primary combustion chamber 76. In a preferred embodiment, this can be done by configuring transfer bin 32 and its lid 34 such that lid 34 can be placed between the opening into transfer bin 32 from feed conduit 36, thereby blocking the flow of pellet fuel 26 from storage bin 28. Once the pellet fuel 26 in transfer bin 32 and fuel chamber 42 is consumed, the stove will shut itself off. In one configuration, the amount of pellet fuel 26 in fuel chamber 42 and transfer bin 32 will be consumed in approximately thirty minutes or so. Alternatively, lid 34 of transfer bin 32 can be configured to close off feed tube opening 44 on the side 46 of feed tube 38 to interrupt the flow of pellet fuel 26 to fuel chamber 42. As will be recognized by those skilled in the art, various other alternative mechanisms are available to interrupt the supply of pellet fuel 26 to primary burn chamber 76 to terminate combustion therein and "turn off" pellet stove 10.

When necessary to clean fuel chamber 42, the user merely operates cleaning handle 120 to open the flapper-type valve in feed tube 38, thereby allowing very hot air to flow upward into feed tube 38 and burn off any residue build-up along the interior walls of feed tube 38, including feed chamber 42. If the user determines it is necessary to clean or advantageous to replace primary burn chamber 76, he or she merely operates handle 82 to open closure mechanism 80 and remove burn unit 58 from the first end 14 of vent tube 12 (after allowing it to cool appropriately). The user then removes pellet receptacle 70 from burn unit 58 and either cleans it or replaces it. The user can take advantage of the removable burn unit 58 to resize or change the configuration of primary combustion chamber 76 to obtain more or less combustion and, therefore, more or less heat output from pellet stove 10.

As set forth above, pellet stove 10 of the present invention provides significant benefits over presently available and other prior art pellet stoves. The use of a gravity feed system to deliver pellet fuel 26 to the primary 54 and secondary 56 combustion areas, as shown along fuel path F, eliminates the need for a mechanical pellet feed system that requires electricity or other source of power to operate. In addition, the use of a natural draft system to provide the air necessary for combustion of pellet fuel 26 eliminates the need for the use of an external air supply, such as from an electric fan or the like. The use of a dual combustion area provides more complete burning of pellet fuel 26 to more effectively utilize pellet fuel 26, improve the air quality of the exhaust emissions and reduce solid waste (ash) output. With the gravity feed, natural draft benefits and complete burning of pellet fuel 26, pellet stove 10 of the present invention can more efficiently and effectively heat the interior of a structure than prior art pellet stoves while consuming less resources and producing significantly less air pollution and solid waste.

Figure 8:
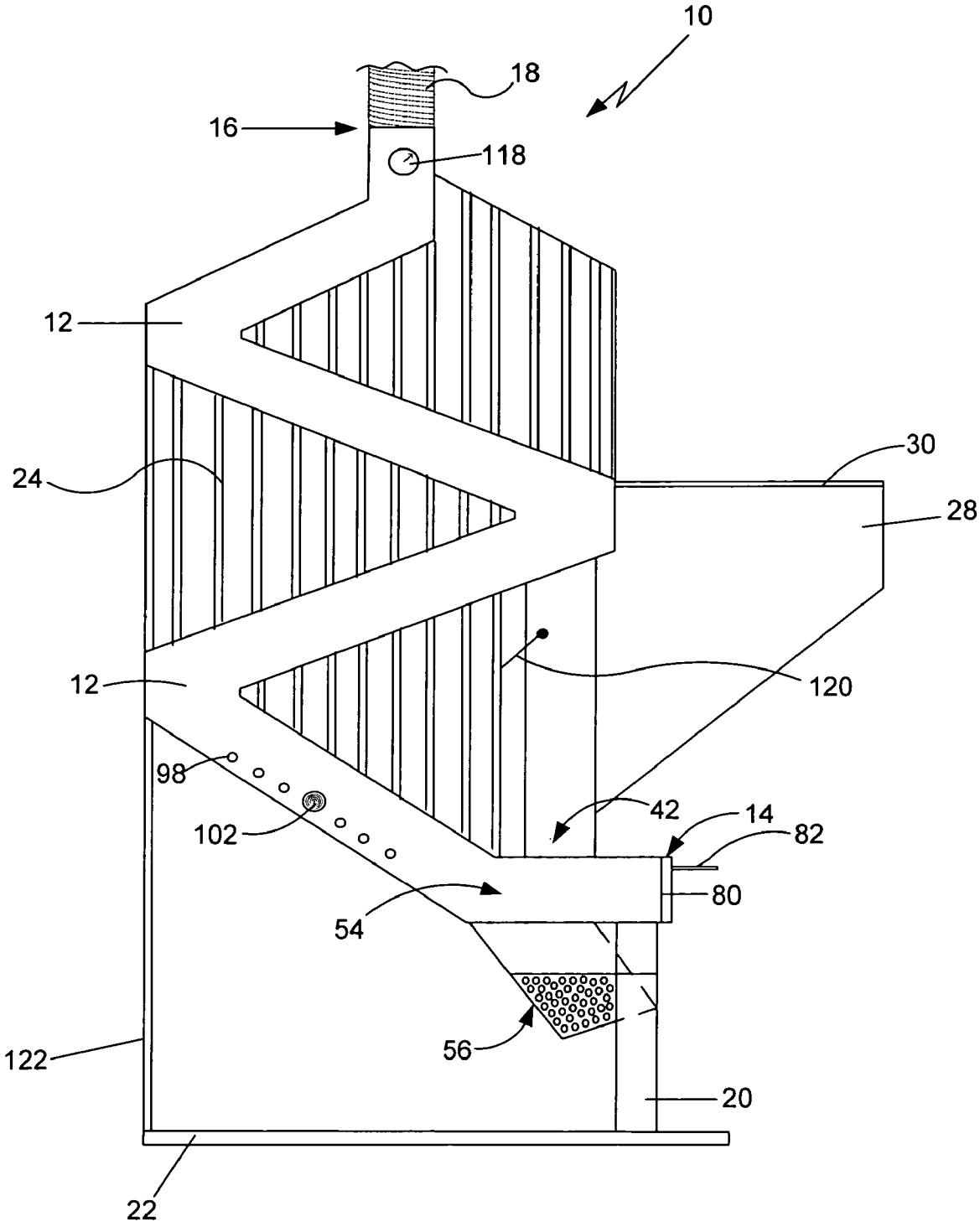
FIG. 8 is an alternative configuration of the pellet stove of the present invention showing a curved support member at one end and the storage bin disposed so as to feed pellet fuel directly into the fuel chamber above the primary burn chamber (i.e., without passing through the feed conduit and transfer bin of the embodiment of FIG. 1).

As set forth above, pellet stove 10 of the present invention can be provided in a variety of different configurations, such as that set forth in FIG. 8. In the embodiment shown in FIG. 8, shown without back plate 106 and heated air channel 112 of the embodiment in FIG. 1, a curved support member 122 supports one end of pellet stove 10 in its generally upright position and the transfer bin 32 and feed conduit 36 of FIG. 1 are eliminated. Curved support member 122 is sized and configured to support a portion of the weight of pellet stove 10, yet be a smaller size and more "art" look than the use of vertical support member 20 at both ends of pellet stove 10 as utilized in the embodiment of FIG. 1. As shown in FIG. 8, storage bin 28 attaches directly to feed tube 38 to allow pellet fuel 26 to fall through feed tube opening 44 into fuel chamber 42 above the primary combustion area 54. Except that the pellet fuel does not flow through the feed conduit 36 into transfer bin 32 prior to feed chamber 42 of FIG. 1, the embodiment shown in FIG. 8 operates the same way. Specifically, pellet fuel 26 is placed into fuel chamber 42 in a manner such that pellet fuel 26 is disposed into primary burn chamber 76 of pellet receptacle 70 from substantially directly above primary burn chamber 76. To turn off pellet stove 10 in a preferred embodiment of FIG. 8, a mechanism for interrupting the flow of pellet fuel 26 between storage bin 28 and fuel chamber 42 is provided. As those skilled in the art will recognize, a variety of different designs and configurations are suitable for pellet stove 10 having the improvements of the present invention. first 36 and second 38 ends of support bar 34 pivotally attach to the supporting framework, such as first frame member.

In an alternative configuration of pellet stove 10 of the present invention, pellet stove 10 can also include a decorative front panel, not shown, that is disposed in front of vent tube 12 and any vertical support members 20 and heat members 24. In one configuration, the front panel can be made out of sheet metal and incorporate a design cut or etched into the front panel. Pellet stove 10 can also be enclosed in a box-type container, making it more of a heater than a stove, that is connected to a structures central heating distribution system to deliver heat throughout the structure's duct system. In such a configuration, it may be beneficial to provide a fan or other blower mechanism to force the heated air under pressure into the duct system so as to better distribute the heated air throughout the structure. In another alternative embodiment, pellet stove 10 can be provided with an attached or integral lighting mechanism for providing the initial flame necessary to light pellet fuel 26 and initiate the automatic draft and fuel feed features of the present invention. In yet another alternative embodiment of the present invention, components of the primary combustion area 54 and the secondary combustion area 56 can be provided as unit, either separately or integrally, that can be utilized to convert an existing pellet or other fuel burning stove provide the features and advantages of pellet stove 10 of the present invention. In such an embodiment, the user could be provided with (as may be necessary) burn unit 58, including pellet receptacle 70 to define primary burn chamber 76, the first end 14 of vent tube 12, burn box 84 to define secondary burn chamber 85 and any necessary fuel delivery components in order to have pellet fuel 26 feed into the primary burn chamber 76 substantially from directly above pellet receptacle 70.

While there are shown and described herein one or more specific forms of the present invention, it will be readily apparent to those skilled in the art that the invention is not so limited, namely that the invention is susceptible to various modifications and rearrangements in design and materials without departing from the spirit and scope of the present invention. In particular, it should be noted that the present invention is subject to modification with regard to any dimensional relationships set forth herein and modifications in assembly, materials, size, shape and use. For instance, there are numerous materials and components described herein that can be replaced with equivalent materials and functioning components to accomplish the objectives of the present invention.

What is claimed is:

1. A pellet stove, comprising:

a vent tube having a first end, a second end, a top side and a bottom side, said top side having an upper vent feed opening, said bottom side having a lower vent feed opening;

means at said first end of said vent tube for closing said first end of said vent tube;

a feed tube extending upwardly from said top side of said vent tube, said feed tube defining a fuel chamber, said fuel chamber disposed above said upper vent feed opening;

means attached to said feed tube for discharging pellet fuel into said fuel chamber;

a primary combustion area at said first end of said vent tube, said primary combustion area comprising a burn unit having a first end, a second end and a pellet receptacle disposed therebetween, said pellet receptacle having one or more side walls and a bottom wall with one or more receptacle openings, said pellet receptacle defining a primary burn chamber configured to receive said pellet fuel from said fuel chamber, said burn unit removably received through said first end of said vent tube and positioned in said vent tube so as to dispose said primary burn chamber between said upper vent feed opening and said lower vent feed opening, said closing means disposed at said first end of said burn unit;

a secondary combustion area comprising a burn box disposed below said lower vent feed opening, said burn box defining a secondary burn chamber configured to receive said pellet fuel from said primary burn chamber, said burn box having one or more air openings for receiving air into said secondary combustion area and said primary combustion area;

one or more vent openings on said vent tube, said one or more vent openings disposed between said primary combustion area and said second end of said vent tube; and means associated with said vent openings for controlling said vent openings, said controlling means configured to selectively open and close one or more of said vent openings, wherein an air path is established from said air openings to said secondary combustion area, said primary combustion area and then said vent tube so as to exit said second end of said vent tube and wherein said controlling means increases air velocity along said air path by closing said one or more of said vent openings so as to increase heat produced by said pellet stove and decreases air velocity along said air path by opening said one or more of said vent openings so as to decrease heat produced by said pellet stove.

2. The pellet stove according to claim 1, wherein said pellet receptacle is removably disposed in said burn unit.

3. The pellet stove according to claim 1, wherein said closing means is adapted to position said primary burn chamber between said upper vent feed opening and said lower vent feed opening.

4. The pellet stove according to claim 1, wherein said pellet receptacle is removably disposed in said burn unit.

5. The pellet stove according to claim 1 further comprising an ash tray disposed below said burn box, said burn box configured with a plurality of ash openings on a bottom side thereof, said ash tray configured to receive ash from said burn box through said plurality of ash openings.

6. The pellet stove according to claim 1, wherein said discharging means is configured to gravity feed said pellet fuel into said fuel chamber.

7. The pellet stove according to claim 1, wherein said secondary burn chamber receives pellet fuel through said one or more receptacle openings on said bottom wall of said pellet receptacle.

8. The pellet stove according to claim 1, wherein said controlling means is on said vent tube.

9. The pellet stove according to claim 1, wherein said burn box is attached to said bottom side of said vent tube.

10. The pellet stove according to claim 1, wherein said feed tube has a feed tube opening and said discharging means comprises a storage bin configured to hold said pellet fuel, said storage bin adapted to gravity feed said pellet fuel to said fuel chamber through said feed tube opening.

11. The pellet stove according to claim 1, wherein said primary burn chamber is disposed below said fuel chamber so as to prevent movement of said pellet fuel from said fuel chamber to said primary burn chamber and from said discharging means to said fuel chamber until a burned portion of said pellet fuel in said primary burn chamber falls into said secondary burn chamber.

12. A pellet stove, comprising:

a vent tube having a first end, a second end, a top side and a bottom side, said top side having an upper vent feed opening, said bottom side having a lower vent feed opening, said second end of said vent tube attached to or integral with an exhaust pipe;

a feed tube extending upwardly from said top side of said vent tube, said feed tube defining a fuel chamber, said fuel chamber disposed above said upper vent feed opening;

means attached to said feed tube for discharging pellet fuel into said fuel chamber, said discharging means configured to gravity feed said pellet fuel into said fuel chamber;

a primary combustion area disposed in said vent tube, said primary combustion area comprising a burn unit removably received in said vent tube through said first end of said vent tube, said burn unit having a first end, a second end and a pellet receptacle disposed therebetween, said pellet receptacle configured to receive said pellet fuel from said fuel chamber and define a primary burn chamber, said burn unit positioned in said vent tube so as to dispose said primary burn chamber between said upper vent feed opening and said lower vent feed opening;

a secondary combustion area comprising a burn box disposed below said lower vent feed opening, said burn box defining a secondary burn chamber configured to receive said pellet fuel from said primary burn chamber, said burn box having one or more air openings for receiving air into said secondary combustion area and said primary combustion area and define an air path therethrough to said exhaust pipe;

means on said burn unit for closing said first end of said vent tube, said closing means adapted to position said primary burn chamber between said upper vent feed opening and said lower vent feed opening;

one or more vent openings on said vent tube, said one or more vent openings disposed between said primary combustion area and said second end of said vent tube; and means on said vent tube for controlling said one or more vent openings so as to regulate the flow of air in said air path, said controlling means configured to selectively open and close one or more of said vent openings so as to decrease air velocity along said air path by opening said one or more of said vent openings to decrease heat produced by said pellet stove and increase air velocity along said air path by closing said one or more of said vent openings to increase heat produced by said pellet stove.

13. The pellet stove according to claim 12, wherein said pellet receptacle is removably disposed in said burn unit.

14. The pellet stove according to claim 12, wherein said feed tube has a feed tube opening and said discharging means comprises a storage bin configured to hold said pellet fuel, said storage bin adapted to gravity feed said pellet fuel to said fuel chamber through said feed tube opening.

15. The pellet stove according to claim 14, wherein said primary burn chamber is disposed below said fuel chamber so as to prevent movement of said pellet fuel from said fuel chamber to said primary burn chamber and from said discharging means to said fuel chamber until a burned portion of said pellet fuel in said primary burn chamber falls into said secondary burn chamber.

16. A pellet stove, comprising:

a tube defining a primary combustion area at a first end of said tube and an exhaust tube at a second end of said tube, said primary combustion area comprising a burn unit in said tube, said burn unit having a first end, a second end and a pellet receptacle disposed therebetween, said pellet receptacle defining a primary burn chamber, said burn unit removably received through said first end of said tube;

means disposed on said first end of said burn unit for closing said first end of said tube;

a feed tube extending upwardly from said tube, said feed tube defining a fuel chamber, said fuel chamber disposed above said primary burn chamber;

means attached to said feed tube for discharging pellet fuel into said fuel chamber, said fuel chamber configured to dispose said pellet fuel into said primary burn chamber of said pellet receptacle;

a secondary combustion area comprising a burn box disposed below said primary burn chamber, said burn box defining a secondary burn chamber configured to receive said pellet fuel from said primary burn chamber, said burn box having one or more air openings for receiving air into said secondary combustion area and said primary combustion area, wherein an air path is established from said air openings to said secondary combustion area, said primary combustion area and to said second end of said tube;

one or more vent openings on said tube, said one or more vent openings disposed between said primary combustion area and said second end of said tube; and means associated with said vent openings for controlling said vent openings, said controlling means configured to selectively open and close one or more of said vent openings so as to decrease air velocity along said air path by opening said one or more of said vent openings to decrease heat produced by said pellet stove and increase air velocity along said air path by closing said one or more of said vent openings to increase heat produced by said pellet stove.

17. The pellet stove according to claim 16, wherein said exhaust tube is integral with or attached to said tube at said second end of said tube.

18. The pellet stove according to claim 16, wherein said primary burn chamber is disposed below said fuel chamber so as to prevent movement of said pellet fuel from said fuel chamber to said primary burn chamber and from said discharging means to said fuel chamber until a burned portion of said pellet fuel in said primary burn chamber falls into said secondary burn chamber.

19. The pellet stove according to claim 16, wherein said feed tube has a feed tube opening and said discharging means comprises a storage bin configured to hold said pellet fuel, said storage bin adapted to gravity feed said pellet fuel to said fuel chamber through said feed tube opening.

20. The pellet stove according to claim 16, wherein said pellet receptacle is removably disposed in said burn unit.

* * * * *